US008820336B1

(12) United States Patent
Schneberger

(10) Patent No.: US 8,820,336 B1
(45) Date of Patent: Sep. 2, 2014

(54) FLEXIBLE UMBRELLA HOLDER

(71) Applicant: Dennis Duane Schneberger, Fort Worth, TX (US)

(72) Inventor: Dennis Duane Schneberger, Fort Worth, TX (US)

( * ) Notice: Subject to any disclaimer, the term of this patent is extended or adjusted under 35 U.S.C. 154(b) by 0 days.

(21) Appl. No.: 13/771,453

(22) Filed: Feb. 20, 2013

(51) Int. Cl.
*A45B 3/00* (2006.01)

(52) U.S. Cl.
USPC ..... 135/16; 135/20.1; 248/288.31

(58) Field of Classification Search
USPC ..... 135/15.1, 16, 20.1, 25.4; 248/288.31, 248/288.51, 228.6, 231.71, 229.12, 251, 248/539, 514–516, 6; 403/56, 76, 90, 122
See application file for complete search history.

(56) References Cited

U.S. PATENT DOCUMENTS

| | | | | |
|---|---|---|---|---|
| 2,559,421 | A | 7/1951 | Garrett et al. | |
| 2,822,143 | A | 2/1958 | Johansen et al. | |
| 2,950,836 | A * | 8/1960 | Murdock | 220/576 |
| 3,050,280 | A | 8/1962 | Regan et al. | |
| 3,304,035 | A * | 2/1967 | Davis | 248/516 |
| 3,304,036 | A * | 2/1967 | Davis | 248/514 |
| 3,637,046 | A | 1/1972 | Emmons et al. | |
| 3,765,434 | A | 10/1973 | Riggs et al. | |
| 3,848,838 | A | 11/1974 | Thomas | |
| 4,919,379 | A | 4/1990 | Goetz | |
| 5,293,889 | A * | 3/1994 | Hall et al. | 135/16 |
| 5,350,215 | A * | 9/1994 | DeMars | 297/188.14 |
| 5,431,364 | A * | 7/1995 | Etter | 248/514 |
| D396,185 | S | 7/1998 | Fraser | |
| 5,836,327 | A | 11/1998 | Davis | |
| D413,429 | S | 9/1999 | Carson | |
| 6,405,742 | B1 * | 6/2002 | Driscoll | 135/96 |
| 6,533,237 | B1 * | 3/2003 | Matusek | 248/514 |
| 6,601,813 | B1 * | 8/2003 | Kager et al. | 248/314 |
| 2012/0180831 | A1 * | 7/2012 | April et al. | 135/16 |

* cited by examiner

*Primary Examiner* — Winnie Yip

(57) ABSTRACT

The present invention features an umbrella holder system with ball joint for shade angle adjustment. The system features a general U-shaped base, a ball joint and an umbrella with a handle. The ball joint has an upper opening adapted to receive the umbrella handle and a lower part connected to the U-shaped base. The U-shaped base can be secured to a support structure via a screwed handle. The ball joint has a ball with a threaded rod or a plurality of holes for position securing. The umbrella is pivotably attached to the U-shaped case and can be secured to a desired position.

8 Claims, 8 Drawing Sheets

(Front View)

(Front View)

120
124
122
137
131
133
132
135
136
134
143
141
144
148
147
142
145

(Top View)

(Side View)

Detailed view of the ball of the ball joint (Front View)

FLEXIBLE UMBRELLA HOLDER

FIELD OF THE INVENTION

The present invention related to an umbrella holder, and more particularly to an umbrella holder with ball joint for shade angle adjustment.

BACKGROUND OF THE INVENTION

It is a common practice to have an umbrella to provide a shield from the sun or rain. However it is also common that the umbrella is held in a fixed position, such as an upright position, instead of a desired position. It would be advantageous to have an umbrella holder that can hold the umbrella at a desired angle to provide a user protection from the weather and the angle can be adjusted with convenience. It would be further desirable if the umbrella holder could be flexibly securable to a variety of support bases. Hence, there is a need for an umbrella holder to provide more flexibility.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features an umbrella holder system with ball joint for shade angle adjustment. The system comprises a general U-shaped base, a ball joint and an umbrella with handle. The ball joint has an upper opening adapted to receive the umbrella handle and a lower part connected to the U-shaped base. The U-shaped base can be secured to a support structure via a screwed handle. The ball joint has a ball with a plurality of holes for various position securing. The umbrella is pivotably attached to the U-shaped base and can be secured to a desired position via a pin or screwed bolt.

DESCRIPTION OF PREFERRED EMBODIMENTS

Figure 1:
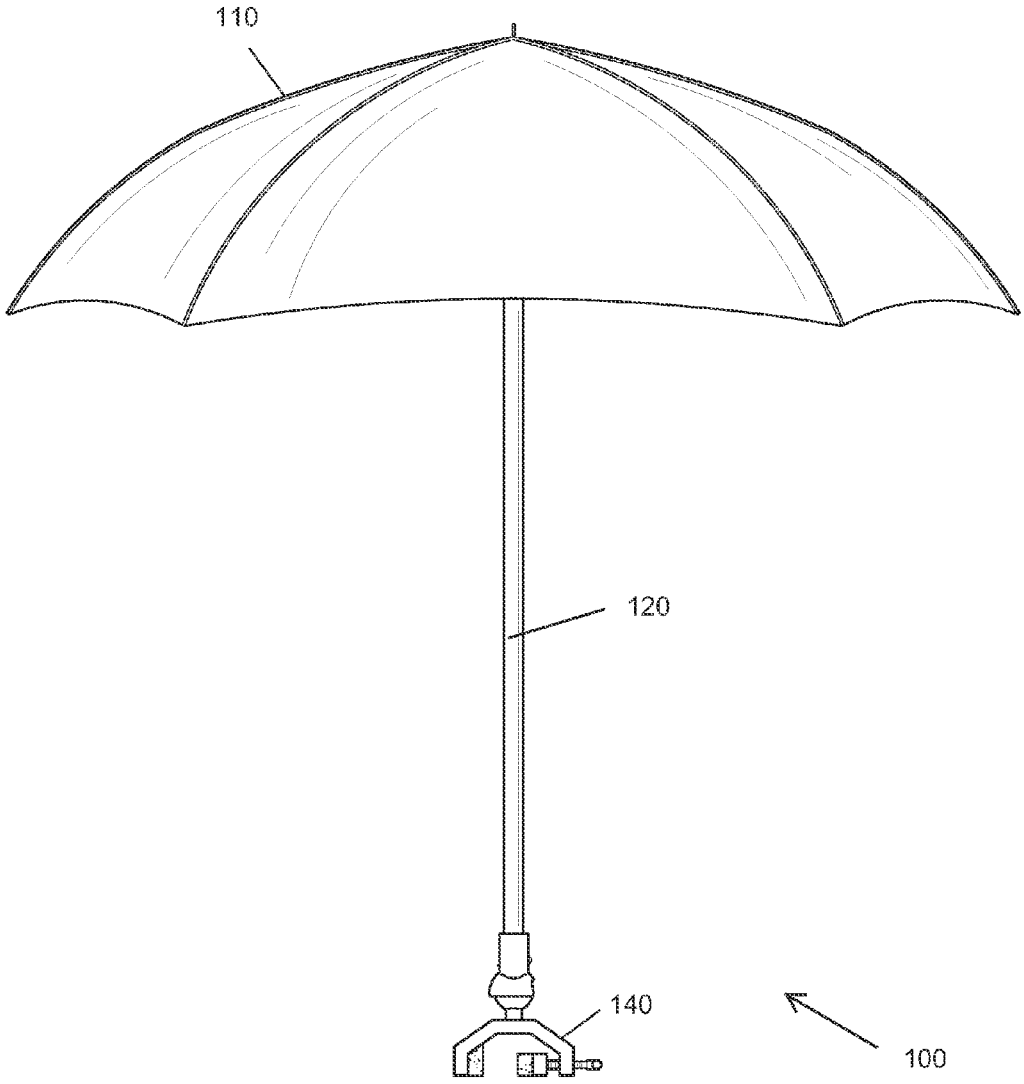
FIG. 1 shows a front view of an umbrella holder system.
Figure 2:
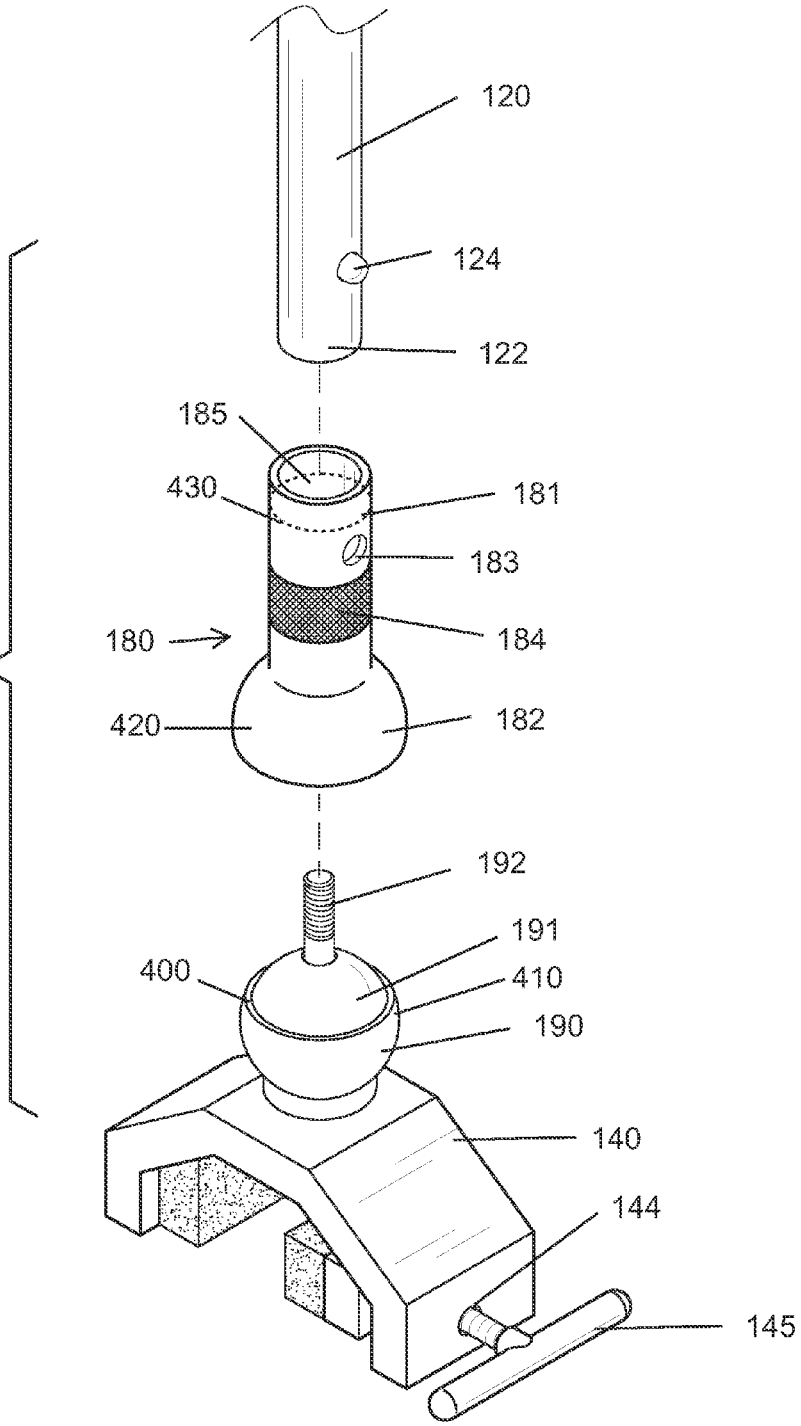
FIG. 2 shows an isometric view of the umbrella holder system.
Figure 3:
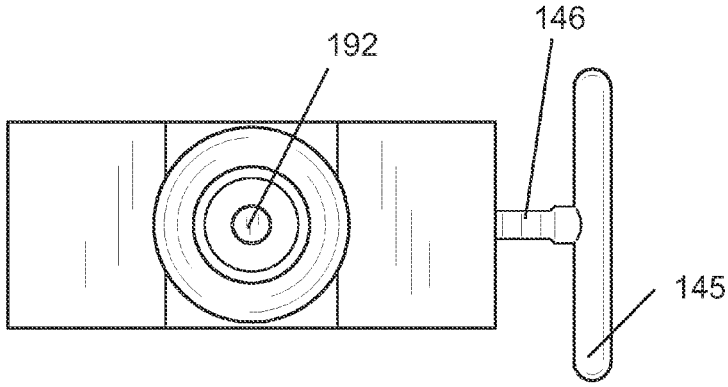
FIG. 3 shows a top view of the umbrella holder system.
Figure 4:
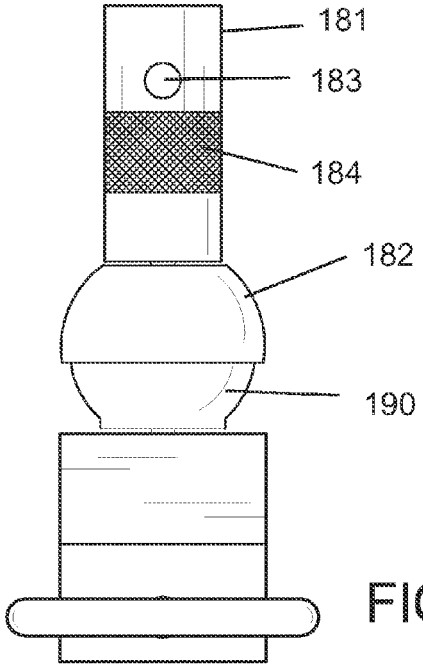
FIG. 4 shows a side view of the umbrella holder system.
Figure 5:
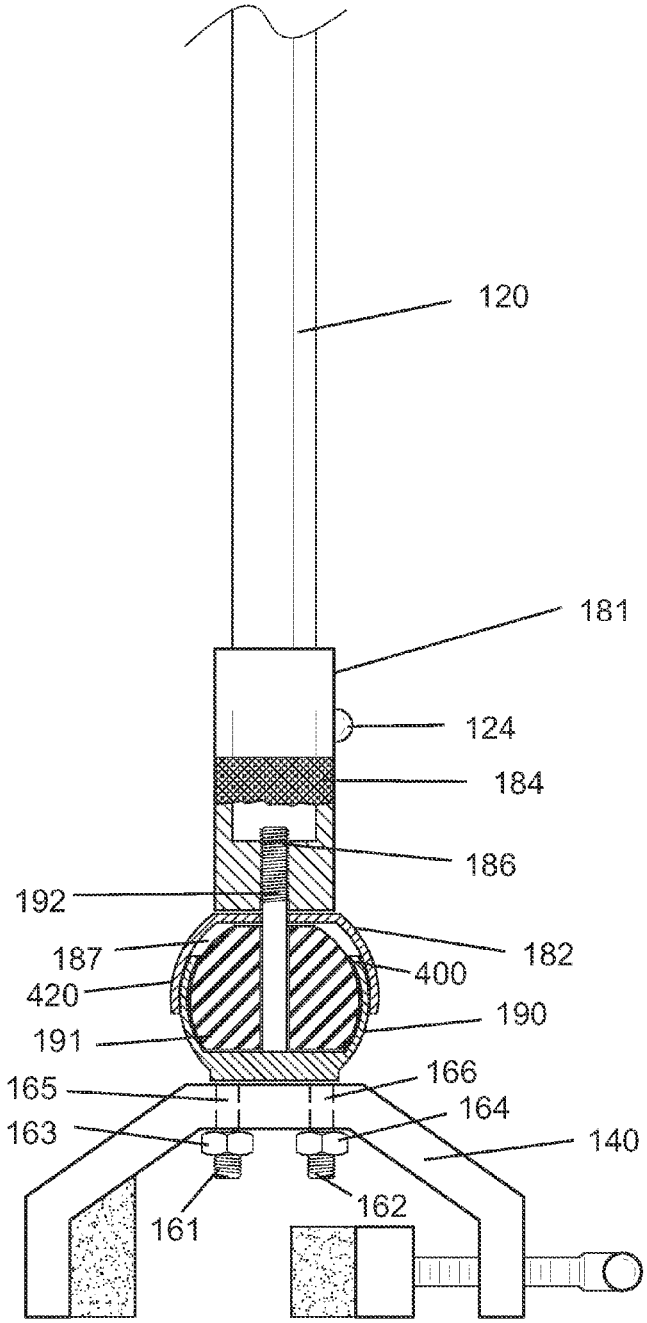
FIG. 5 shows a cross-sectional view of the umbrella holder system.
Figure 6:
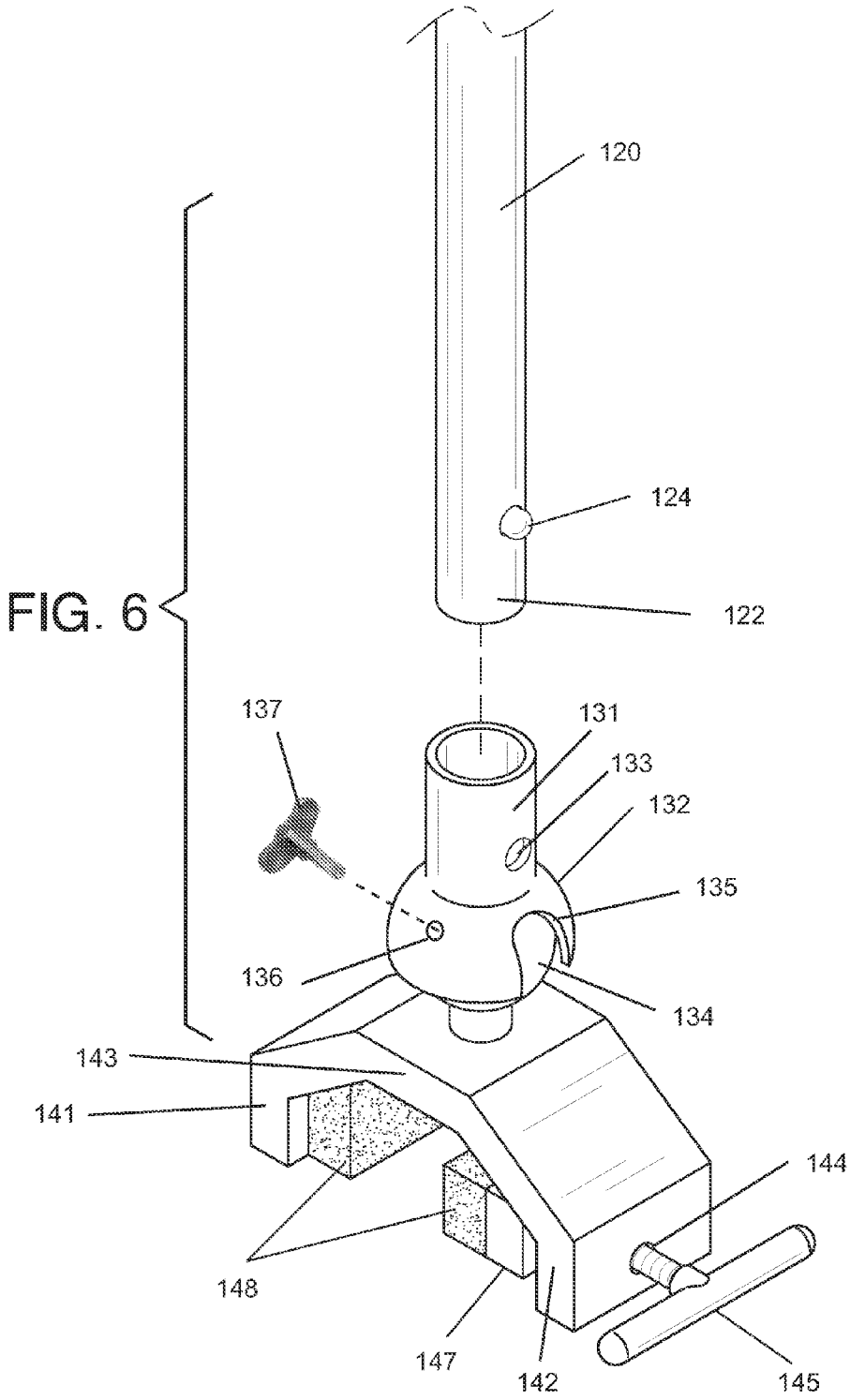
FIG. 6 shows an isometric view of an alternative umbrella holder system.
Figure 7:
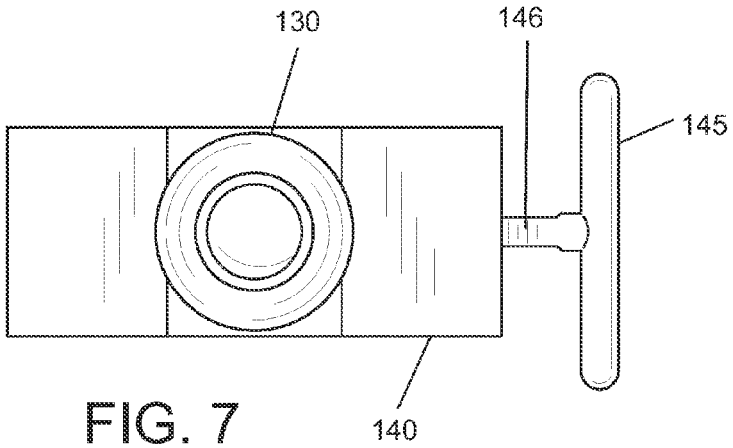
FIG. 7 shows a top view of the alternative umbrella holder system.
Figure 8:
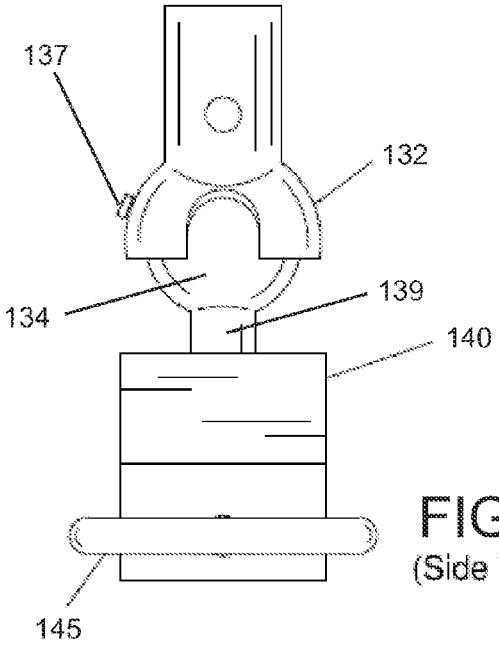
FIG. 8 shows a side view of the alternative umbrella holder system.
Figure 9:
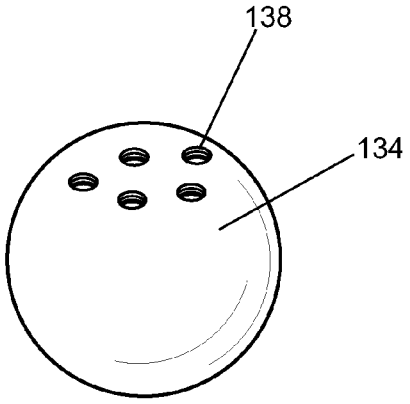
FIG. 9 shows a detailed view of ball inside the ball joint of the alternative umbrella holder system.
Figure 10:
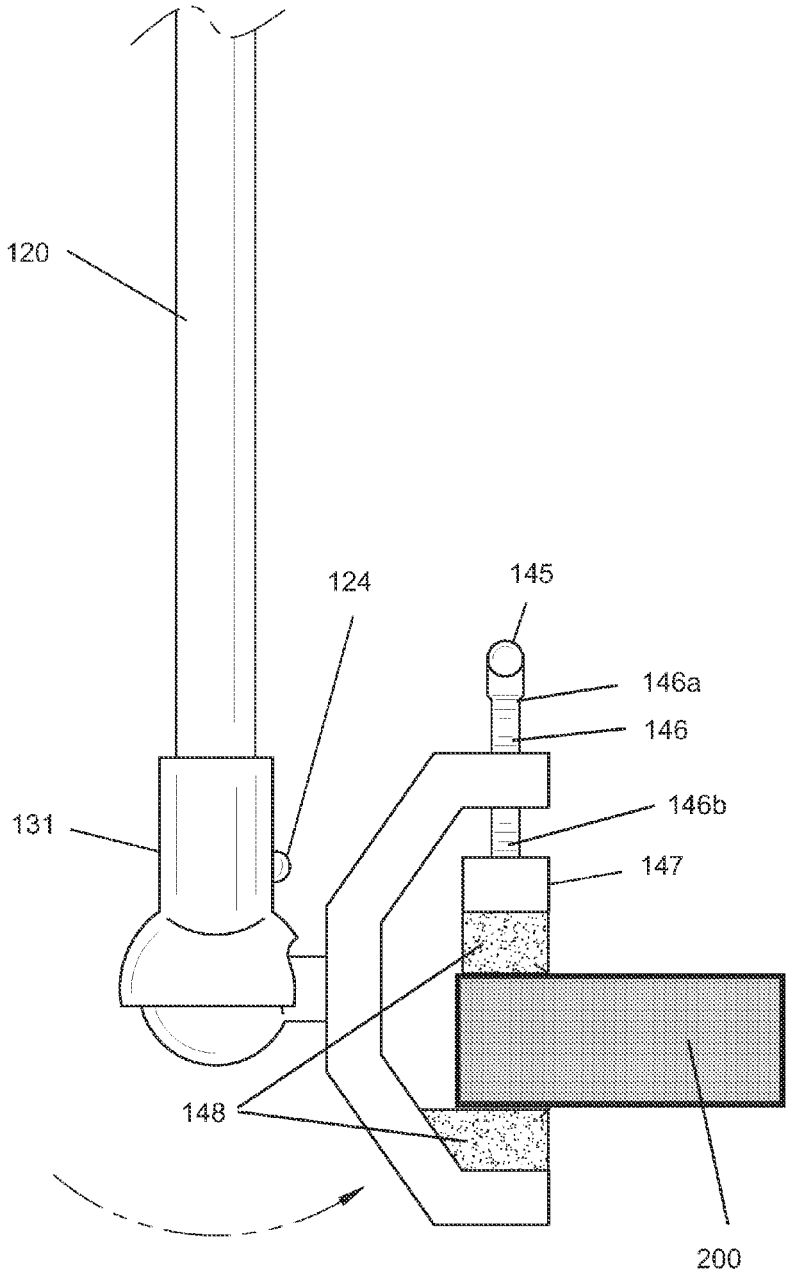
FIG. 10 shows an alternative front view of the alternative umbrella holder system.

Referring now to FIGS. 1-10, the present invention features an umbrella holder system (100) comprising an umbrella (110), a straight handle (120) with a lower end (132), a ball-joint top (180), a ball-joint housing (190) and a U-shaped base (140).

The ball-joint top (180) comprises a hollow semi-sphere lid (182) with a side wall curvature (420) and a tubular bracelet (181) located uprightly on the semi-sphere lid (182). In some embodiments, the lid (182) has a downward opening (187). In some embodiments, the tubular bracelet (181) has an upper opening (185) and a lower opening (186). In some embodiments, the upper opening (185) is configured to receive the straight handle (120). In some embodiments, the lower opening (186) is threaded and connects to the lid opening (187).

The hollow semi-sphere ball-joint housing (190) has a joint ball (191) and resides securely and pivotably within the ball-joint housing (190). In some embodiments, the ball-joint housing (190) comprises an upper lip (400) located on a top end (410). In some embodiments, a threaded rod (192) is located uprightly on the joint ball (191). In some embodiments, the threaded rod (192) is configured to removably engage to the threaded lower opening (186). In some embodiments, the ball-joint housing (130) is configured to be enclosed snugly by the semi-sphere lid (182) when the threaded rod (192) is threaded into the threaded lower opening (186). In some embodiments, upon rotating the threaded rod (192) into the lower opening (186), the upper lip (400) is compressed against and scrapes the side wall curvature (420) of the lid (182). In some embodiments, the upper lip (400) jams into and sticks tightly against the side wall curvature (420) of the lid (182) to immobilize movement of the ball-joint top (180) and the ball-joint housing (190).

The U-shaped base (140) has a first side arm (141), a second side arm (142) and a middle arm (143). In some embodiments, the ball-joint housing (190) is located on the middle arm (143). In some embodiments, the second side arm (142) has a threaded hole (144) to engage a threaded screw (146) having a first thread end (146*a*) and a second thread end (146*b*). In some embodiments, an adjustment handle (146) is located on the first thread end (146*a*) and a squeezing plate (147) is rotatably located on the second thread end (146*b*). In some embodiments, the squeezing plate (147) is parallel to the first arm (141). In some embodiments, the handle is rotatable to push the squeezing plate (147) to firmly sandwich an external support base (200) between the squeezing plate (147) and the first arm (141).

In some embodiments, the tubular bracelet (181) further comprises a bracelet hole (183) located on the tubular bracelet (181). In some embodiments, the straight handle (120) further comprises a spring loaded button (124) located near the lower end (122). In some embodiments, the bracelet hole (183) is adapted to receive the spring loaded button (124) such that the straight handle (120) is securely attached to the tubular bracelet (181).

In some embodiments, the tubular bracelet (181) further comprises an anti-slippery layer (184) (such as a knurled pattern rolled on the tubular bracelet) along the tubular bracelet circumference (430).

In some embodiments, the ball-joint housing (190) is removably located on the middle arm (143) via a first threaded bolt (155) and a second threaded bolt (166). In some embodiments, the first threaded boll (165) passes through the middle arm (143) and is locked by a first nut (161). In some embodiments, the second threaded bolt (166) passes through the middle arm (143) and is locked by a second nut (161).

Referring now to FIG. 6-10, the present invention features an alternative embodiment of the umbrella holder system (100) comprising an umbrella (110), a straight handle (120) with a lower end (122), a ball joint (130) and a U-shaped base (140).

In the alternative embodiment of the umbrella holder system (100), the ball joint (130) has a ball housing (132) and a joint ball (134) with a pivot arm (139) connected on the joint ball (134). In some embodiments, the joint ball (134) resides securely and pivotably within the ball housing (132). In some embodiments, a tubular bracelet (131) is located uprightly on the ball housing (132). In some embodiments, the tubular bracelet (131) is configured to snugly held the straight handle (120).

In some embodiments, the straight handle (120) is height adjustable. For example, the straight handle (120) is a telescope handle. In some embodiments, the straight handle (120) has a length between 3 feet and 5 feet. In some embodiments, the straight handle (120) has a length between 5 feet and 8 feet. In some embodiments, the straight handle (120) has a length between 8 feet and 10 feet.

The U-shaped base (140) has a first side arm (141), a second side arm (142) and a middle arm (143). In some embodiments, the pivot arm (139) is located on the middle arm (143). In some embodiments, the second side arm (142) has a threaded hole (144) to engage a threaded screw (146) having a first thread end (146*a*) and a second thread end (146*b*). In some embodiments, an adjustment handle (146) is located on the first thread end (146*a*) and a squeezing plate (147) is rotatably located on the second thread end (146*b*). In some embodiments, the squeezing plate (147) is parallel to the first arm (141). In some embodiments, the handle is rotatable to push the squeezing plate (147) to firmly sandwich an external support base (200) between the squeezing plate (147) and the first arm (141).

In some embodiments, a protective cushion layer (148) is located on both the squeezing plate (147) and the first side arm (141). In some embodiments, the protective cushion layer (148) functions to protect the external support base (200) from any possible squeezing marks or damages. In some embodiments, the protective cushion layer (148) is made from rubber. In some embodiments, the protective cushion layer (148) is made from a plastics.

In some embodiments, a groove (135) is located on the ball housing (132). In some embodiments, the groove (135) has a profile to receive the pivot arm (139) such that the pivot arm (139) can be pivoted up to a position where the pivot arm (139) is perpendicular to the tubular bracelet (131). In some embodiments, the pivot arm is cylindrical and the groove (135) has a half circle shape. In some embodiments, the pivot arm is square and the groove (135) has a square or rectangle shape.

In some embodiments, the tubular bracelet (131) further comprises a bracelet hole (133) located on the tubular bracelet (131) and the straight handle (120) further comprises a spring loaded button (124) located near the lower end (122). In some embodiments, the hole is adapted to receive the spring loaded button (124) such that the straight handle (120) is securely attached to the tubular bracelet (131). In some embodiments, the straight handle (120) comprises a threaded hole located near the lower end (122) and the handle is locked to the tubular bracelet (131) via an external screw passing through the bracelet hole (133) and engaging the threaded hole on the straight handle (120).

In some embodiments, the joint ball (134) comprises a plurality of holes (138). In some embodiments, a housing hole (136) is located on the ball housing (132). In some embodiments, the joint ball (134) is lockable at a desired position in regarding to the ball housing (132) with a pin (137) inserted through the housing hole (136) and connected to a selected hole (138) on the joint ball (134). In some embodiments, the holes (138) on the joint ball (134) are threaded and the pin (137) is a screw bolt with matching thread to the holes (138). The holes (138) on the joint ball (134) and the housing hole (136) allow the umbrella to be adjustable and secured at a desired position. For example, the umbrella can be secured at a position facing the upcoming wind or facing the Sun. This feature would be advantageous over other umbrella mounting system where the umbrella is always uprightly mounted.

As used herein, the term "about" refers to plus or minus 10% of the referenced number. For example, a handle (120) of a length of 5 feel is referred as a handle with a length between 4.5 feet and 5.5 feet.

The disclosures of the following U.S. Patents are incorporated in their entirety by reference herein: U.S. Pat. No. 3,050,280, U.S. Pat. No. 3,637,046, U.S. Pat. No. 3,765,434, U.S. Pat. No. 3,848,838, U.S. Pat. No. 4,919,379, U.S. Pat. No. 5,836,327.

Various modifications of the invention, in addition to those described herein, will be apparent to those skilled in the art from the foregoing description. Such modifications are also intended to fall within the scope of the appended claims. Each reference cited in the present application is incorporated herein by reference in its entirely.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. An umbrella holder system (100) with ball joint for shade angle adjustment, the system comprising:

(a) an umbrella (110) with a straight handle (120), wherein the straight handle has a lower end (122);

(b) a ball-joint top (180) comprising a hollow semi-sphere lid (182) with a side wall curvature (420) and a tubular bracelet (181) disposed uprightly on the semi-sphere lid (182), wherein the lid (182) has a downward opening (187), wherein the tubular bracelet (181) has an upper opening (185) and a lower opening (186), wherein the upper opening (185) is configured to receive the straight handle (120), wherein the lower opening (186) is threaded and connects to the lid opening (187);

(c) a hollow semi-sphere ball-joint housing (190) with a joint ball (191) residing securely and pivotably within the ball-joint housing (190), wherein the ball joint housing (190) comprises an upper lip (400) disposed on a top end (410) thereon, wherein a threaded rod (192) is disposed uprightly on the joint ball (191), wherein the threaded rod (192) is configured to removably engage the threaded lower opening (186), wherein the ball-joint housing (190) is configured to be enclosed snugly by the semi-sphere lid (182) when the threaded rod (192) is threaded into the threaded lower opening (186), wherein upon rotating the threaded rod (192) into the lower opening (186), the upper lip (400) is compressed against and scrapes the side wall curvature (420) of the lid (182), wherein the upper lip (400) jams into and sticks tightly against the side wall curvature (420) of the lid (182) to immobilize movement of the ball-joint top (180) and the ball- joint housing (190);

(d) a U-shaped base (140) with a first side arm (141), a second side arm (142) and a middle arm (143), wherein the ball-joint housing (190) is disposed on the middle arm (143), wherein the second side arm (142) has a threaded hole (144) to engage a threaded screw (146) having a first thread end (146*a*) and a second thread end (146*b*), wherein an adjustment handle (146) is disposed on the first thread end (146*a*) and a squeezing plate (147) is rotatably disposed on the second thread end (146*b*), wherein the squeezing plate (147) is parallel to the first arm (141), wherein the handle is rotatable to push the squeezing plate (147) to firmly sandwich an external support base (200) between the squeezing plate (147) and the first arm (141).

2. The umbrella holder system (100) of claim 1, wherein the tubular bracelet (181) further comprises a bracelet hole (183) disposed on the tubular bracelet (181), wherein the straight handle (120) further comprises a spring loaded button (124) disposed near the lower end (122), wherein the bracelet hole (183) is adapted to receive the spring loaded button (124) such that the straight handle (120) is securely attached to the tubular bracelet (181).

3. The umbrella holder system (100) of claim 1, wherein the tubular bracelet (181) further comprises an anti-slip layer (184) along a tubular bracelet circumference (430).

4. The umbrella holder system (100) of claim 3, wherein the anti-slip layer (184) is a knurled pattern rolled on the tubular bracelet (181).

5. The umbrella holder system (100) of claim 1, wherein the ball-joint housing (190) is removably disposed on the middle arm (143) via a first threaded bolt (165) and a second threaded bolt (166), wherein the first threaded bolt (165) passes through the middle arm (143) and is locked by a first nut (161), wherein the second threaded bolt (166) passes through the middle arm (143) and is locked by a second nut (161).

6. An umbrella holder system (100) with ball joint for shade angle adjustment, the system comprising:

(a) an umbrella (110) with a straight handle (120), wherein the straight handle has a lower end (122);

(b) a ball joint (130) with a ball housing (132) and a joint ball (134) with a pivot arm (139) connected on the joint ball (134), wherein the joint ball (134) resides securely and pivotably within the ball housing (132), wherein a tubular bracelet (131) is disposed uprightly on the ball housing (132), wherein the tubular bracelet (131) is configured to snugly hold the straight handle (120); and (c) a U-shaped base (140) with a first side arm (141), a second side arm (142) and a middle arm (143), wherein the pivot arm (139) is disposed on the middle arm (143), wherein the second side arm (142) has a threaded hole (144) to engage a threaded screw (146) having a first thread end (146*a*) and a second thread end (146*b*), wherein an adjustment handle (146) is disposed on the first thread end (146*a*) and a squeezing plate (147) is rotatably disposed on the second thread end (146*b*), wherein the squeezing plate (147) is parallel to the first arm (141), wherein the handle is rotatable to push the squeezing plate (147) to firmly sandwich an external support base (200) between the squeezing plate (147) and the first arm (141);

wherein a groove (135) is disposed on the ball housing (132), wherein the groove (135) has a profile to receive the pivot arm (139) such that the pivot arm (139) can be pivoted up to a position where the pivot arm (139) is perpendicular to the tubular bracelet (131).

7. An umbrella holder system (100) with ball joint for shade angle adjustment, the system comprising:

(a) an umbrella (110) with a straight handle (120), wherein the straight handle has a lower end (122);

(b) a ball joint (130) with a ball housing (132) and a joint ball (134) with a pivot arm (139) connected on the joint ball (134), wherein the joint ball (134) resides securely and pivotably within the ball housing (132), wherein a tubular bracelet (131) is disposed uprightly on the ball housing (132), wherein the tubular bracelet (131) is configured to snugly hold the straight handle (120); and (c) a U-shaped base (140) with a first side arm (141), a second side arm (142) and a middle arm (143), wherein the pivot arm (139) is disposed on the middle arm (143), wherein the second side arm (142) has a threaded hole (144) to engage a threaded screw (146) having a first thread end (146*a*) and a second thread end (146*b*), wherein an adjustment handle (146) is disposed on the first thread end (146*a*) and a squeezing plate (147) is rotatably disposed on the second thread end (146*b*), wherein the squeezing plate (147) is parallel to the first arm (141), wherein the handle is rotatable to push the squeezing plate (147) to firmly sandwich an external support base (200) between the squeezing plate (147) and the first arm (141);

wherein the joint ball (134) comprises a plurality of holes (138), wherein a housing hole (136) is disposed on the ball housing (132), wherein the joint ball (134) is lockable at a desired position in regarding to the ball housing (132) with a pin (137) inserted through the housing hole (136) and connected to a selected hole (138) on the joint ball (134).

8. The umbrella holder system (100) of claim 7, wherein the holes (138) on the joint ball (134) are threaded and the pin (137) is a screw bolt with matching thread to the holes (138).

* * * * *